United States Patent [19]

Saeki et al.

[11] Patent Number: 4,942,107

[45] Date of Patent: Jul. 17, 1990

[54] IMAGE-FORMING MATERIAL AND IMAGE RECORDING METHOD USING THE SAME

[75] Inventors: Keiso Saeki; Tosiaki Endo; Masato Satomura; Fumiaki Shinozaki, all of Shizuoka, Japan

[73] Assignee: Fuji Photo Film Co., Ltd., Kanagawa, Japan

[21] Appl. No.: 320,734

[22] Filed: Mar. 8, 1989

[30] Foreign Application Priority Data

| | | | |
|---|---|---|---|
| Mar. 8, 1988 | [JP] | Japan | 63-54681 |
| Mar. 24, 1988 | [JP] | Japan | 63-70354 |
| Mar. 24, 1988 | [JP] | Japan | 63-70355 |
| Apr. 1, 1988 | [JP] | Japan | 63-80280 |

[51] Int. Cl.[5] ..... G03C 1/72; B41M 1/16

[52] U.S. Cl. ..... 430/138; 430/203; 430/211; 430/224; 503/214; 503/216; 503/218

[58] Field of Search ..... 430/138, 203, 211, 224; 503/214, 216, 218, 221

[56] References Cited

U.S. PATENT DOCUMENTS

| | | | |
|---|---|---|---|
| 4,571,605 | 2/1986 | Morosugi et al. | 503/216 |
| 4,596,997 | 6/1986 | Shinmoto | 503/216 |
| 4,609,928 | 9/1986 | Kubo et al. | 503/216 |
| 4,622,566 | 11/1986 | Kasamatsu et al. | 503/221 |
| 4,707,464 | 11/1987 | Takashima et al. | 503/216 |
| 4,769,305 | 9/1988 | Sano et al. | 430/138 |
| 4,775,656 | 10/1988 | Harada et al. | 430/138 |

*Primary Examiner*—Paul R. Michl
*Assistant Examiner*—Hoa Van Le
*Attorney, Agent, or Firm*—Sughrue, Mion, Zinn, Macpeak & Seas

[57] ABSTRACT

An image-forming material and an image recording method for using the same are disclosed. The image-forming material comprises microcapsule and a reducing agent which is present outside of the microcapsules, wherein the microcapsules contain (a) a leuco dye capable of oxidatively developing a color, (b) a photo-oxidizing agent, and (c) a phenolic compound. The image-forming material exhibits excellent image reproducibility, preservability before use, and image preservability.

20 Claims, No Drawings

IMAGE-FORMING MATERIAL AND IMAGE RECORDING METHOD USING THE SAME

FIELD OF THE INVENTION

This invention relates to an image-forming material and to an image-recording method using the same. More particularly, it relates to an image-recording material useful as proof paper, print-out paper, overlay film, and similar products and to an image-recording method using the same.

BACKGROUND OF THE INVENTION

Free radial photography in which an image-forming material is imagewise exposed to light to visualize the exposed area has been used in many photographic applications.

In a particularly useful photographic image formation system, various leuco dyes are reacted with a photo-oxidizing agent to oxidatively develop a color as described, e.g., in *Photo. Sci. Eng.*, Vol. 5, 98–103 (1961), JP-B-43-29407 (the term "JP-B" as used herein means an "examined published Japanese patent application"), JP-A-55-55335 (corresponding to U.S. Pat. No. 4,271,251), JP-A-57-60329 (corresponding to U.S. Pat. No. 4,298,678) , and JP-A-62-66254 (corresponding to U.S. Pat. No. 4,622,286) (the term "JP-A" as used herein means an "unexamined published Japanese patent application").

These image-forming materials are difficult to handle because they may undergo an undesired color formation reaction, even after the imagewise exposure to light, when exposed to ordinary room light, sun light or white light.

Once an image is formed in the imagewise exposed area, color formation in the unexposed area should be prevented in order to keep the original image. For example, it is known that an original image can be maintained by applying a solution of a reducing agent such as a free radical scavenger (e.g., hydroquinone) to the material by spraying or impregnation after image formation. Although this technique is advantageous for maintenance or fixation of the image, the wet process involved therein inevitably makes the operation complicated.

There are on the market materials which can be processed only with light, for example, "Dylux" (a registered trade name of E. I. DuPont). The materials of this type form an image on exposure to UV light, and the image is then fixed by activation of a photo-reducing substance by visible light. According to this system, however, since light is used twice, the processor must be occupied for the amount of time it takes for light exposure, and exchanges of spectral filters are required. These requirements cause the processing speed to be unsatisfactory for some usages.

JP-B-43-29407 cited above discloses that imagewise exposure can be followed by heat fixation with a reducing heat-fixing agent which has been incorporated into a binder solution together with the leuco dye and photo-oxidizing agent or coated on a photosensitive layer. However, the fact that the fixing agent exists close to the photosensitive part (i.e., the leuco dye and photo-oxidizing agent) undesirably causes deterioration of sensitivity with time.

On the other hand, the image-forming materials containing the leuco dye and photo-oxidizing agent are usually prepared by uniformly dissolving the leuco dye and photo-oxidizing agent in an organic solvent, applying the solution on a support such as paper or plastic film by coating, immersion, casting or similar techniques, and then removing the solvent by drying. Use of such a volatile organic solvent requires the apparatus to have special safety features to guard against danger of explosion, and is hence disadvantageous with respect to safety and cost.

SUMMARY OF THE INVENTION

One object of this invention is to provide an image-forming material excellent in image reproducibility, preservability before use (shelf life stability), and image preservability (fixing properties).

Another object of this invention is to provide an image-forming material which can be produced without using any organic solvent using a reduced amount of an organic solvent.

A further object of this invention is to provide an image recording method which can be performed easily and which is performed in a completely dry process from the step of image formation through the fixation step.

It has now been found that the above objects of this invention are accomplished by an image-forming material comprising microcapsule and a reducing agent which is present outside of the microcapsules, wherein the microcapsules contain (a) a leuco dye capable of oxidatively developing a color, (b) a photo-oxidizing agent, and (c) a phenolic compound selected from the group consisting of:

(a) a compound represented by formula (I):

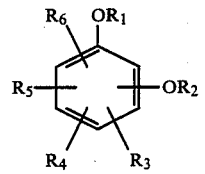

(I)

wherein $R_1$ and $R_2$, which may be the same or different, each represents a hydrogen atom or an alkyl group (preferably having 1 to 12 carbon atoms); $R_3$, $R_4$, $R_5$, and $R_6$, which may be the same or different, each represents a hydrogen atom, an alkyl group (preferably having 1 to 12 carbon atoms), an aryl group (preferably having 6 to 20 carbon atoms), an alkoxy group (preferably having 1 to 10 carbon atoms), an alkylthio group, an acylamino group, a hydroxyl group, or a halogen atom; either OR or $OR_2$, or both can form a 5- or 6-membered ring with any of $R_3$, $R_4$, $R_5$, and $R_6$, which is at ortho-position in relation to $OR_1$ or $OR_2$, respectively, and one or more pairs selected any combination of two of $R_3$, $R_4$, $R_5$ and $R_6$ which are mutually at the ortho-position can form a 5- or 6-membered ring, (b) a compound represented by formula (II):

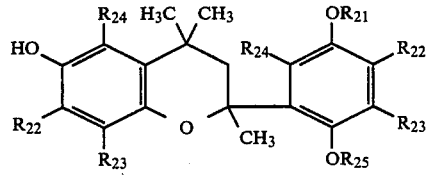

(II)

wherein $R_{21}$ and $R_{25}$ each represents a hydrogen atom, an alkyl group, or a heterocyclic group; and $R_{22}$, $R_{23}$, and $R_{24}$, which may be the same or different, each represents a hydrogen atom, an alkyl group, an aryl group, an alkoxyl group, an aryloxy group, an alkylthio group, an arylthio group, an acylamino group, a diacylamino group, a sulfonamido group, an alkylamino group, an alkoxycarbonyl group, an acyloxy group, or a halogen atom; provided that $R_{21}$ and $R_{25}$ do not simultaneously represent a hydrogen atom, (c) a compound represented by formula (III):

(III)

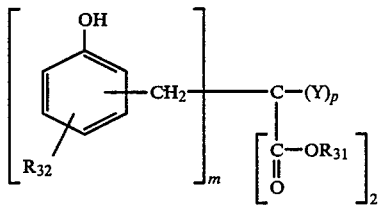

wherein $R_{31}$ represents a substituted or unsubstituted 4-piperidyl group; $R_{32}$ represents a hydogen atom, or one or more substituted or unsubstituted alkyl groups, which may be the same or different, and $R_{32}$is bonded to the benzene ring; Y represents a hydrogen atom or a substituted or unsubstituted alkyl group; m represents 1 or 2; and p represents 0 or 1; provided that m plus p is 2, and (d) a substituted or unsubstituted o-t-butylphenol compound.

The most outstanding characteristic of the image-forming material of the present invention lies in use of microcapsules containing (a) leuco dye, (b) a photo-oxidizing agent, and (c) a specific phenolic compound.

In general, the basic functions possessed by microcapsules are:

(1) that the walls of the microcapsules can microscopically separate components contained inside the microcapsules (hereinafter "inner components") from components which are outside of the microcapsules (hereinafter "outer components");

(2) that the inner components are protected from external environmental conditions, i.e., the inner components can be stably preserved even in, e.g., a high temperature and humidity environment for a long period of time;

(3) that the inner components can be brought into contact with the outer components as desired either by releasing the inner components by application of external stimulation, such as heat or pressure, or by introducing the outer components into the inside of the microcapsules; and (4) that the microcapsules, when dispersed in an aqueous system, can themselves be handled as an aqueous system even if the material in the microcapsules is an organic solvent.

The concept of the present invention consists in (A) utilizing the above functions (1) and (2) for improving stability of the system, B) utilizing functions (1) and (3) for simplifying recording steps inclusive of heat fixation after exposure, and C) utilizing function (4) for improving suitability in production.

Further, incorporation of a specific phenol compound into the microcapsules improves pre-use preservability without adversely affecting sensitivity.

DETAILED DESCRIPTION OF THE INVENTION

The microcapsules which are preferably used in the present invention are such that the microcapsule wall prevents inner components from coming into contact with outer components at room temperature, but when heated to a certain temperature or higher, the capsule wall permits certain components to penetrate the capsule wall. The temperature at which penetration starts can be arbitrarily controlled by appropriately selecting wall materials, inner materials, outer materials, and additives. The temperature in this case corresponds to the glass transition temperature of the capsule wall. JP-A-59-91438 (corresponding to U. S. Pat. No. 4,529,681), JP-A-59-190886 and JP-A-60-242094 can be referred to for details.

The glass transition temperature of the capsule wall can be controlled by selection of the wall-forming materials. The wall-forming materials which can be used in the microcapsules of the present invention include polyurethane, polyurea, polyester, polycarbonate, urea-formaldehyde resins, melamine-formaldehyde resins, polystyrene, styrene-methacrylate copolymers, gelatin, polyvinylpyrrolidone, and polyvinyl alcohol. These high polymer substances may be used either individually or in combination of two or more thereof. Preferred capsule wall-forming substances include polyurethane, polyurea, polyamide, polyester and polycarbonate. Polyurethane and polyurea are more preferred.

The microcapsule dispersion of the present invention is preferably prepared by emulsifying an inner material containing a leuco dye, a photo-oxidizing agent, a phenolic compound, an organic solvent, and other reactive substances, and forming capsule walls of a high polymer substance to encapsulize the aforesaid inner material. The reactants for forming the high-moleclar substance are added to the inside and/or outside of the aforesaid inner material. Preferred microcapsules, including preferred processes for their preparation are described, for example, in U.S. Pat. Nos. 3,726,804 and 3,796,696.

For example, when polyurethane is used as a capsule wall-forming substance, a polyfunctional isocyanate is added to an inner phase and a second substance capable of reacting with the polyisocyanate to form a capsule wall (e.g., a polyol) is added to an outer aqueous phase or an oily phase as inner phase. This mixture is dispersed in water to prepare an oil in water type emulsion, and then the temperature of this dispersion is elevated, thereby causing a polymerization reaction at the interface of the oil droplets to form a microcapsule wall. When the second substance is not added or when the second substance is replaced by a polyamine, a capsule wall of polyurea is formed.

The polyfunctional isocyanates and the second substance, e.g., polyols and polyamines, which can be used here are described in U.S. Pat. Nos. 3,281,383, 3,773,695, and 3,793,268, JP-B-48-40347, JP-B-49-24159 (corresponding to U.S. Pat. No. 3,723,363), and JP-A-48-0191 (corresponding to U.S. Pat. No. 3,838,108) and JP-A-48-84086.

Specific examples of the aforementioned polyfunctional isocyanates include diisocyanates, e.g., m-phenylene diisocyanate, p-phenylene diisocyanate, 2,6-tolylene diisocyanate, 2,4-tolylene diisocyanate, naphthalene-1,4-diisocyanate, diphenylmethane-4,4'-diisocyanate, 3,3'-dimethoxy-4,4'-biphenyl diisocyanate, 3,3'-dimethyldiphenylmethane-4,4'-diisocyanate, xylylene- 1,4-diisocyanate, 4,4'-diphenylpropane diisocyanate, trimethylene diisocyanate, hexamethylene diisocyanate, propylene-1,2-diisocyanate, butylene-1,2-diisocyanate, cyclohexylene-1,2-diisocyanate, and cyclohexylene-1,4-diisocyanate; triisocyanates, e.g., 4,4',4''-triphenylmethane triisocyanate and toluene-2,4,6-triisocyanate; tetraisocyanates, e.g., 4,4'-dimethyldiphenylmethane-2,2',5,5'-tetraisocyanate; and isocyanate prepolymers, e.g., an adduct of hexamethylene diisocyanate and trimethylolpropane, an adduct of 2,4-tolylene diisocyanate and trimethylolpropane, and adduct of xylylene diisocyanate and trimethylolpropane, and an adduct of tolylene diisocyanate and hexanetriol.

Specific examples of the aforementioned polyols include aliphatic or aromatic polyhydric alcohols, hydroxypolyesters, and hydroxypolyalkylene ethers.

The polyols described in JP A-60-49991 (corresponding to U.S. Pat. No. 4,650,740) are also employable, including ethylene glycol, 1,3-propanediol, 1,4-butanediol, 1,5-pentanediol, 1,6-hexanediol, 1,7-heptanediol, 1,8-octanediol, propylene glycol, 2,3-dihydroxybutane, 1,2-dihydroxybutane, 1,3-dihydroxybutane, 2,2-dimethyl-1,3-propanediol, 2,4-pentanediol, 2,5-hexanediol, 3-methyl-1,5-pentanediol, 1,4-cyclohexanedimethanol, dihydroxycyclohexane, diethylene glycol, 1,2,6-trihydroxyhexane, 2-phenylpropylene glycol, 1,1,1-trimethylolpropane, hexanetriol, pentaerythritol, a pentaerythritol-ethylene oxide adduct, a glycerin-ethylene oxide adduct, glycerin, 1,4-di(2-hydroxyethoxy)benzene, a condensate of an aromatic polyhydric alcohol (e.g., resorcinol dihydroxyethyl ether) and an alkylene oxide, p-xylylene glycol, m-xylylene glycol, $\alpha,\alpha'$-dihydroxy-p-diisopropylbenzene, 4,4'-dihydroxydiphenylmethane, 2-(p,p'-dihydroxydiphenylmethyl)-benzyl alcohol, an adduct of bisphenol A and ethylene oxide, and an adduct of bisphenol A and propylene oxide.

The polyol is preferably used in such an amount that the proportion of the hydroxyl group is from 0.02 to 2 mols per mol of an isocyanate group.

Specific examples of the aforementioned polyamines are ethylenediamine, trimethylediamine, tetramethylenediamine, pentamethylenediamine, hexamethylenediamine, p-phenylenediamine, m-phenylenediamine, piperazine, 2-methylpiperazine, 2,5-dimethylpiperazine, 2-hydroxytrimethylenediamine, diethylenetriamine, triethylenetriamine, triethylenetetramine, diethylaminopropylamine, tetraethylenepentamine, and an amine adduct of an epoxy compound.

The aforementioned polyfunctional isocyanates may form a high polymer substance by reaction with water.

The aforementioned organic solvent which is contained in the inner material for the purpose of forming oil droplets is usually selected from high-boiling oils, e.g., phosphoric esters, phthalic esters, acrylic esters, methacrylic esters, other carboxylic acid esters, fatty acid amides, alkylated biphenyls, alkylated terphenyls, chlorinated paraffin, alkylated naphthalenes, and diarylethanes. Further spedific examples are described in JP-A-60-242094 and Japanese Patent Application No. 62-75409.

If desired, the organic solvent may be used in combination with a low-boiling auxiliary solvent as a dissolution aid. Examples of such auxiliary solvents preferably include ethyl acetate, isopropyl acetate, butyl acetate, and methylene chloride.

A water-soluble high polymer which is incorporated as a protective colloid into an aqueous phase to be mixed with the oily phase can be selected appropriately from known anionic high polymers, nonionic high polymers, and amphoteric high polymers. Preferred among these polymers are polyvinyl alcohol, gelatin, and cellulose derivatives.

A surface active agent which is incorporated into an aqueous phase can be appropriately selected from known anionic or nonionic surface active agents so that the surface active agent selected may not act on the above-described protective colloid to cause precipitation or agglomeration. Examples of preferred surface active agents include are sodium alkylbenzenesulfonates (e.g., sodium laurylsulfate), dioctyl sodium sulfosuccinate, and polyalkylene glycols (e.g., polyoxyethylene nonylphenyl ether).

From the standpoint of improvement in resolution, preservability and ease of handling, the microcapsules of the present invention preferably have a size of not greater than 20 $\mu$m, and particularly not greater than 4 $\mu$m, in terms of volume average particle size as measured in accordance with the method described, e.g., in JP-A-60-214990 (corresponding to U.S. Pat. No. 4,598,035). If the size of the microcapsules is too small, there is a concern that the microcapsules would disappear in pores or fibers of a substrate or a support. The lower limit of the capsule size is preferably 0.1 $\mu$m, but the size depends on the properties of the substrate or support used.

The leuco dyes which can be used in the present invention include reducing dyes having one or two hydrogen atoms and capable of forming a color on removal of the hydrogen atom(s) and, in some cases, addition of an electron(s). Since such leuco dyes are substantially colorless or, in some cases, faintly colored, they serve as a means of pattern formation upon oxidative color formation.

In the present invention, the oxidation of the leuco dye can be effected in the presence of at least one photo-oxidizing agent. The photo-oxidizing agent is activated by light irradiation and then reacted with the leuco dye to form a color image against the background of the non-irradiated and hence unchanged substance.

Leuco dyes capable of easily forming a color on oxidation through the mechanism stated above include those described in U.S. Pat. No. 3,445,234. Specific examples thereof are shown below for reference.

(a) Aminotriarylmethanes
(b) Aminoxanthenes
(c) Aminothioxanthenes
(d) Amino-9,10-dihydroacridines
(e) Aminophenoxazines
(f) Aminophenothiazines
(g) Aminodihydrophenazines
(h) Aminodiphenylmethanes
(i) Leucoindamines
(j) Aminohydrocinamic acids (cyanoethane, leucomethine)
(k) Hydrazines
(l) Leuco-indigoid dyes
(m) Amino-2,3-dihydroanthaquinones
(n) Tetrahalo-p,p'-biphenols
(o) 2-(p-Hydroxyphenyl)-4,5-diphenylimidazoles
(p) Phenethylanilines Of the above-enumerated leuco dyes, (a) to (i), each become a color-forming dye when it loses one hydrogen atom while each of (j) to (p) becomes a color-forming dye when it loses two hydrogen atoms. Preferred among dyes (a) to (p) are the aminotriarylmethanes.

The preferred aminotriarylmethanes are those wherein at least two of the aryl groups are phenyl groups each having N-substituents R' and R" at the para-position with respect to the methane carbon atom, R' and R" being selected from a hydrogen atom, an alkyl group having from 1 to 10 carbon atoms, a 2-hydroxyethyl group, a 2-cyanoethyl group, and a benzyl group, and also having a substituent selected from a lower alkyl group having from 1 to 4 carbon atoms, a lower alkoxy group having from 1 to 4 carbon atoms, a fluorine atom, a chlorine atom, a bromine atom, and a hydrogen atom at the ortho-position with respect to the methane carbon atom, with the third aryl group being the same as or different from the above-described two aryl groups; and acid addition salts thereof. In cases where the third aryl group is different from the other two, this third aryl group is selected from (i) a phenyl group which may be substituted with a lower alkyl group, a lower alkoxyl group, a chlorine atom, a diphenylamino group, a cyano group, a nitro group, a hydroxyl group, a fluorine atom, a bromine atom, an alkylthio group, an arylthio group, a thioester group, an alkylsulfo group, an arylsulfo group, a sulfo group, a sulfonamido group, an alkylamido group, an arylamido group, etc., (ii) a naphthyl group which may be substituted with an amino group, a di-lower alkylamino group, or an alkylamino group, (iii) a pyridyl group which may be substituted with an alkyl group, (iv) a quinolyl group, and (v) an indolinylidene group which may be substituted with an alkyl group. The more preferred aminotriarylmethanes are those wherein R' and R" each represents a hydrogen atom or an alkyl group having from 1 to 4 carbon atoms. The most preferred aminotriarylmethanes are those wherein all of the three aryl groups are the same.

When the aminotriarylmethanes as described above and other leuco dyes are applied to photographic film, paper or other systems as an image forming material according to conventional systems, they sometimes undergo dark color-forming reactions to cause dark fog or coloring. Nevertheless, the novel materials using microcapsules according to the present invention make it possible to utilize such leuco dyes without any problem. This is because the microcapsules function to preserve the leuco dye by isolating it from air, thereby inhibiting such dark color-forming reactions.

The photo-oxidizing agent which can be preferably used in the image-forming material of the invention remains inactive until it is exposed to actinic radiation, such as visible rays, ultraviolet rays, infrared rays, or X-rays. Photo-oxidizing agents have varying peak sensitivity over the whole region of their spectra depending on the chemical structure thereof. The sensitivity of a specifically selected photo-oxidizing agent thus depends on the properties of actinic light used for activation. Upon exposure to radiation, the photo-oxidizing agent produces an oxidizing agent capable of oxidizing the color-forming agent to a colored compound.

Typical photo-oxidizing agents which can be used in the present invention include halogenated hydrocarbons, e.g., carbon tetrabromide, N-bromosuccinimide, and tribromomethylphenylsulfone as described in U.S. Pat. Nos. 3,042,515 and 3,502,476; azide polymers as described in Nippon Shashin Gakkai (ed.), *Shunki Kenkyu Happyokai Koen Yoshi* (1968), p. 55; azide compounds, e.g., 2-azidobenzoxazole, benzoylazide, and 2-azidobenzimidazole, as described in U.S. Pat. No. 3,282,693; the compounds disclosed in U.S. Pat. No. 3,615,568, e.g., 3'-ethyl-1-methoxy-2-pyridothiacyanine perchlorate and 1-methoxy-2-methylpyridinium p-toluenesulfonate; lophine dimer compounds, e.g., 2,4,5-triarylimidazole dimers, as described in JP-B-62-39728; benzophenones; p-aminophenyl ketones; polynuclear quinones; thioxanthenones; and mixture thereof. Preferred among these photo-oxidizing agents are lophine dimer compounds and organic halogen compounds, with combinations thereof being particularly preferred for obtaining high sensitivity.

The above-mentioned lophine dimer compounds can be represented by formula (L-1) shown below and form corresponding 2,4,5-triarylimidazolyl groups after dissociation:

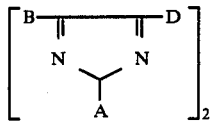

(L-1)

wherein A, B, and D, which may be the same or different, each represents a carbocyclic or heterocyclic aryl group which may be substituted with one or more substituents which do not interfere with either (a) dissociation of the dimer into imidazolyl groups or (b) oxidation of a leuco dye.

In formula (L-1), the group represented by B or D usually carries up to 3 substituents, and the group represented by A usually carries up to 4 substituents. Useful lophine dimer compounds and processes for preparing them are disclosed in U.S. Pat. No. 3,552,973, Col. 4, Line 22 to Col. 6, Line 3.

The above-mentioned organic halogen compounds may be solid or liquid and may contain up to 40 carbon atoms. Examples of such organic halogen compounds include:

(1) compounds represented by formula (H-1):

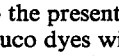

$$R_y\text{-}CX_3 \quad \text{(H-1)}$$

Wherein $R_y$ represents a hydrogen atom, a halogen atom, or an aryl group; and X represents a halogen atom, such as carbon tetrachloride, carbon tetrabromide, p-nitrobenzotribromide, bromotrichloromethane, benzotrichloride, hexabromoethane, iodoform, 1,1,1-tribromo-2-methyl-2-propanol, 1,1,2,2-tetrabromoethane, 2,2,2-tribromoethanol, and 1,1,1-trichloro-2-methyl-2-propanol;

(2) compounds represented by formula (H-2):

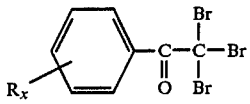

(H-2)

wherein $R_x$ represents a hydrogen atom having from 1 to 5 substituents on the benzene ring, which maybe the same or different, selected from a nitro group, a halogen atom, an alkyl group, a haloalkyl group, an acetyl group, a haloacetyl group, and an alkoxy group, such as o-nitro-α,α,α-tribromoacetophenone, m-nitro-α,α,α-tribromoacetophenone, p-nitro-α,α,α-tribromoacetophenone, α,α,α-tribromoacetophenone, and α,α,α-tribromo-3,4-cycloacetophenone;

(3) compounds represented by formula (H-3):

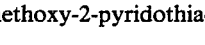

$$R_z\text{-}SO_2\text{-}X \quad \text{(H-3)}$$

wherein $R_z$ represents a substituted or unsubstituted alkyl group or a substituted or unsubstituted aryl group; and X represents a halogen atom, such as 1,3-benzenedisulfonyl chloride, 2,4-dinitrobenzenesulfonyl chloride, o-nitrobenzenesulfonyl chlorid, m-nitrobenzenesulfonyl chloride, 3,3'-diphenylsulfonedisulfonyl chloride, ethanesulfonyl chloride, p-bromobenzenesulfonyl chloride, p-nitrobenzenesulfonyl chloride, p-iodobenzenesulfonyl chloride, p-acetamidobenzenesulfonyl chloride, p-chlorobenzenesulfonyl chloride, p-toluenesulfonyl chloride, methanesulfonyl chloride, and benzenesulfonyl bromide;

(4) compounds represented by formula (H-4):

$$R_a\text{-S-X} \qquad \text{(H-4)}$$

wherein $R_a$ represents a substituted or unsubstituted alkyl group or a substituted or unsubstituted aryl group; and X represents a halogen atom, such as 2,4-dinitrobenzenesulfenyl chloride and o-nitrobenzenesulfenyl chloride;

(5) compounds represented by formula (H-5a) or (H-5b):

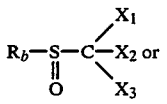
(H-5a)

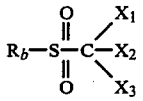
(H-5b)

wherein $R_b$ represents a substituted or unsubstituted aryl group or a substituted or unsubstituted heterocyclic group; and $X_1$, $X_2$, and $X_3$ each represents a hydrogen atom or a halogen atom, provided that all of them do not simultaneously represent a hydrogen atom, such as hexabromodimethyl sulfoxide, pentabromodimethyl sulfoxide, hexabromodimethylsulfone, trichloromethylphenylsulfone, tribromomethylphenylsulfone, trichloromethyl-p-chlorophenylsulfone, tribromomethyl-p-nitrophenylsulfone, 2-trichloromethylbenzothiazolesulfone, 4,6-dimethylpyrimidyl-2-tribromomethylsulfone, tetrabromodimethylsulfone, 2,4-dichlorophenyltrichloromethylsulfone, 2-methyl-4-chlorophenyl-trichloromethylsulfone, 2,5-dimethyl-4-chlorophenyl-trichloromethylsulfone, and 2,4-dichlorophenyl-tribromomethylsulfone; and (6) compounds represented by formula (H-6):

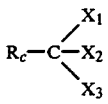
(H-6)

wherein $R_c$ represents a substituted or unsubstituted residual group of a heterocyclic compound; and $X_1$, $X_2$, and $X_3$ each represents a hydrogen atom or a halogen atom, provided that all of them do not simultaneously represent a hydrogen atom, such as tribromoquinaldine, 2-tribromomethyl-4-methylquinoline, 4-tribromomethylpyrimidine, 4-phenyl-6-tribromomethylpyrimidine, 2-trichloromethyl-6-nitrobenzothiazole, 1-phenyl-3-trichloromethylpyrazole, 2,5-di-tribromomethyl-3,4-dibromothiophene, 2 -trichloromethyl-5-(p-butoxystyryl)-1,3,4-oxadiazole, and 2,6-ditrichloromethyl-4-(p-methoxyphenyl)triazine.

Preferred of these organic halogen compounds are those represented by formulae (H-2), (H-5a), (H-5b), and (H-6), and the halogen atom in these compounds is preferably chlorine, bromine, or iodine.

In the preparation of the image-forming material of the present invention, better results can be obtained by mixing the leuco dye and the photo-oxidizing agent at a molar ratio of from about 10:1 to about 1:10, more preferably from 2:1 to 1:2.

Specific examples of the phenolic compound which can be incorporated into the microcapsules of the present invention are described below.

Of the phenolic compounds represented by formula (I), those wherein $OR_2$ is at the ortho- or para-position with respect to $OR_1$ are preferred. More preferred are those represented by formulae (I-a), (I-b), (I-c), (I-d), and (I-e) shown below.

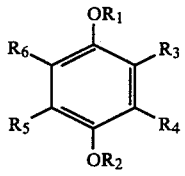
(I-a)

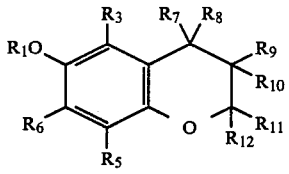
(I-b)

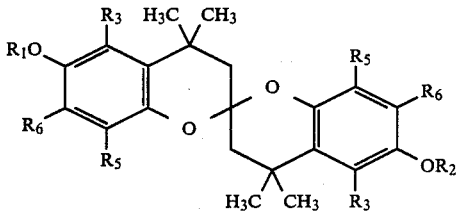
(I-c)

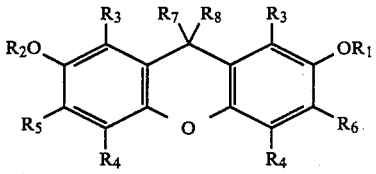
(I-d)

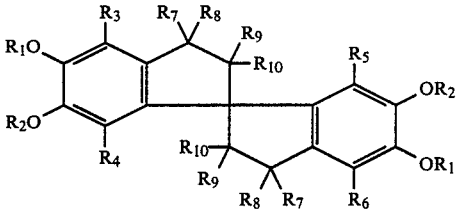
(I-e)

wherein $R_1$, $R_2$, $R_3$, $R_4$, $R_5$, and $R_6$ are as defined above; and $R_7$, $R_8$, $R_9$, $R_{10}$, $R_{11}$, and $R_{12}$, which may be the same or different, each represents a hydrogen atom, a straight chain, branched chain, or cyclic alkyl group having from 1 to 20 carbon atoms (e.g., methyl, ethyl, n-butyl, n-octyl, cyclohexyl), an aryl group having from 6 to 20 carbon atoms (e.g., phenyl, naphethyl), an alkoxy group having from 1 to 20 carbon atoms (e.g., methoxy, n-butoxy, n-octyloxy), a heterocyclic group (e.g., morpholinyl), an alkylamino group having from 1 to 20 carbon atoms (e.g., diethylamino, dibutylamino, n-octylamino), or an alkoxycarbonyl group having from 1 to 20 carbon atoms in the alkoxy moiety thereof (e.g., ethoxycarbonyl, n-hexyloxycarbonyl).

The phenolic compounds of formula (I) can be used either individually or in combination.

The compounds of formula (I) can be synthesized easily according to known processes, such as the processes disclosed in U.S. Pat. Nos. 4,360,589 and 4,273,864, JP-A-55-50244 (corresponding to U.S. Pat. No. 4,266,020), JP-A-53-20327 (corresponding to U.S. Pat. No. 4,159,910), JP-A-53-77526 (corresponding to U.S. Pat. No. 4,155,765), and JP-A-59-10539 (corresponding to U.S. Pat. Nos. 4,616,082 and 4,631,252), and JP-B-57-37856, and analogues thereof.

Specific examples of the compounds of formula (I) are shown below for illustrative purposes only; the present invention is not to be construed as being limited thereto.

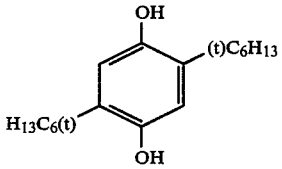

I-1

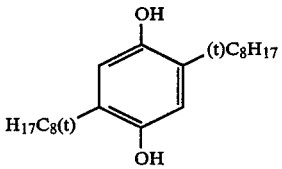

I-2

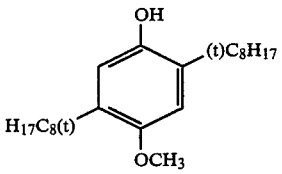

I-3

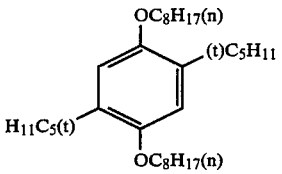

I-4

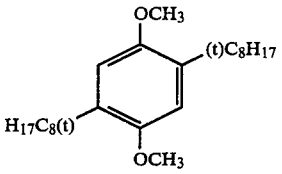

I-5

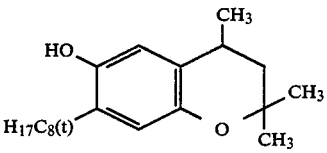

I-6

-continued

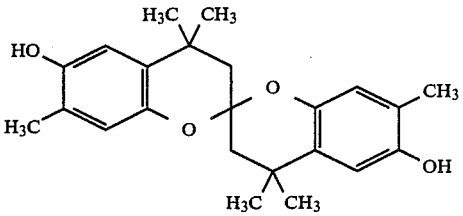

I-7

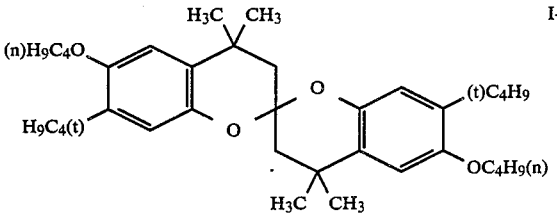

I-8

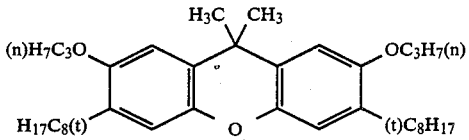

I-9

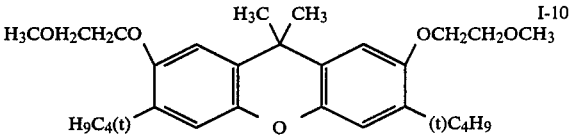

I-10

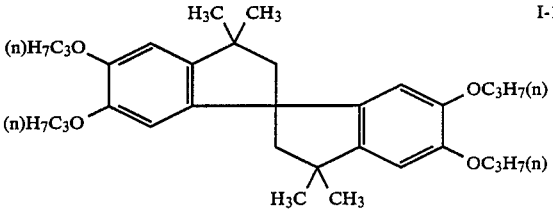

I-11

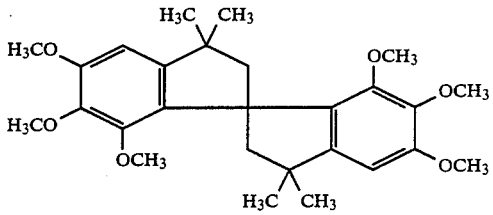

I-12

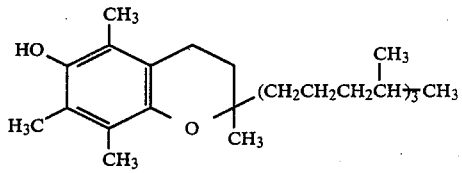

I-13

In formula (II), $R_{21}$ and $R_{25}$ each represents a hydrogen atom; an alkyl group, preferably having up to 20 carbon atoms, including a straight or branched chain alkyl group, an aralkyl group, an alkenyl group, a cycloalkyl group, and a cycloalkenyl group (e.g., methyl, n-butyl, t-butyl, n-octyl, n-dodecyl, n-hexadecyl, benzyl, allyl, cyclopentyl, cyclohexenyl); or a heterocyclic group (e.g., tetrahydropyranyl); provided that $R_{21}$ and $R_{25}$ do not simultaneously represent a hydrogen atom. It is preferable that One of $R_{21}$ and $R_{25}$ is a hydrogen and the other is an alkyl group.

$R_{22}$, $R_{23}$, and $R_{24}$ each represents a hydrogen atom; an alkyl group, preferably having up to. 20 carbon atoms, including a straight or branched chain alkyl group, an aralkyl group, an alkenyl group, a cycloalkyl group, and a cycloalkenyl group (e.g., methyl, ethyl, isopropyl, t-butyl, t-octyl, n-octyl, t-hexadecyl, benzyl, allyl, cyclopentyl, cyclohexenyl); an aryl group, preferably having up to 20 carbon atoms (e.g., phenyl, p-methylphenyl, p-methoxyphenyl, p-octaneamidophenyl, o-chlorophenyl, o-naphthyl); an alkoxy group, preferably having up to 20 carbon atoms (e.g., methoxy, t-butoxy, cyclohexyloxy, n-dodecyloxy, n-octadecyloxy, benzyloxy, allyloxy); an aryloxy group, preferably having up to 20 carbon atoms (e.g., phenoxy, p-methylphenoxy, p-methoxyphenoxy, m-chlorophenoxy, α-naphthoxy); an alkylthio group, preferably having up to 20 carbon atoms (e.g., methylthio, isobutylthio, n-hexylthio, cyclohexylthio, n-octadecylthio); an arylthio group, preferably having up to 20 carbon atoms (e.g., phenylthio, p-methylphenylthio, o-carboxylphenylthio, m-methylphenylthio, o-methoxycarbonylphenylthio, m-nitrophenylthio); an acylamino group, preferably having up to 20 carbon atoms (e.g., acetylamino, benzoylamino, caproamino); a diacylamino group, preferably having up to 30 carbon atoms (e.g., succinimido, 3-hydantoinyl); a sulfonamido group, preferably having up to 20 carbon atoms (e.g., methanesulfonamido, benzenesulfonamido); an alkylamino group, preferably having up to 30 carbon atoms (e.g., ethylamino, t-butylamino, dioctylamino, n-octadecylamino); an acyl group, preferably having up to 20 carbon atoms (e.g., acetyl, capryl, p-methoxybenzoyl); an alkoxycarbonyl group, preferably having up to 20 carbon atoms (e.g., methoxycarbonyl, t-butoxycarbonyl, n-octadecyloxycarbonyl); an acyloxy group, preferably having up to 20 carbon atoms (e.g., acetoxy, caproxy, lauroxy, benzoyloxy); or a halogen atom (e.g., chlorine, bromine). It is preferable that $R_{23}$ and $R_{24}$ both represent a hydrogen atom.

The alkyl moiety or aryl moiety of the above-recited groups as represented by $R_{21}$, $R_{22}$, $R_{23}$, $R_{24}$, and $R_{25}$ may have one or more substituent(s). Examples of acceptable substituents include an alkyl group, a cycloalkyl group, an alkenyl group, an aryl group, a benzyl group, a halogen atom, a nitro group, a cyano group, a hydroxyl group, an alkyloxy group, a cycloalkyloxy group, an alkenyloxy group, an aryloxy group, a benzyloxy group, an alkylthio group, an arylthio group, an amino group, an alkylamino group, an acylamino group, a sulfonamido group, an alkoxycarbonyl group, a silyl group, an acyl group, an acyloxy group, a sulfamoyl group,.and a sulfonyl group. Of the phenolic compounds represented by formula (II), those represented by formula (II-a) shown below are preferred:

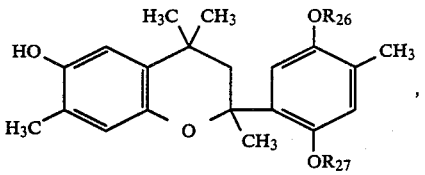

(II-a)

wherein $R_{26}$ and $R_{27}$ each represents a hydrogen atom or an alkyl group, provided that $R_{26}$ and $R_{27}$ do not simultaneously represent a hydrogen atom.

The compounds of formula (II) can be synthesized in accordance with the process described in U.S. Pat. No. 4,264,720. The compounds of formula (II) may be used either individually or in combination.

Specific examples of the compounds of formula (II) are shown below for illustrative purposes; the present invention is not to be construed as being limited thereto.

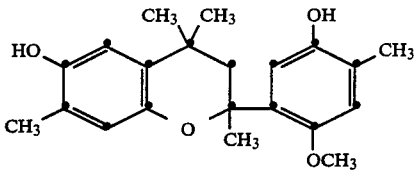

II-1

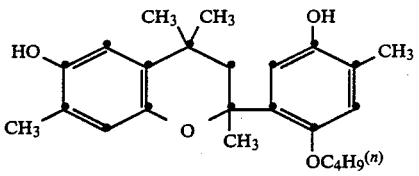

II-2

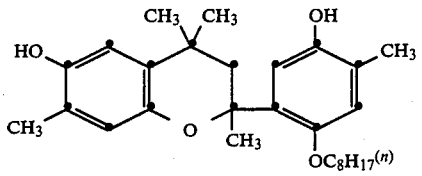

II-3

-continued
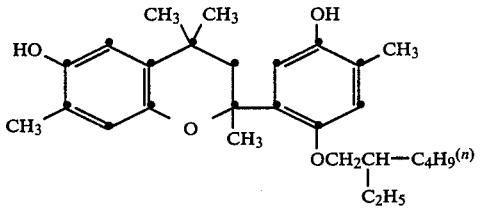
II-4
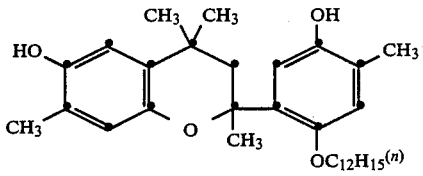
II-5
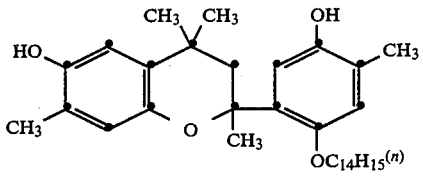
II-6
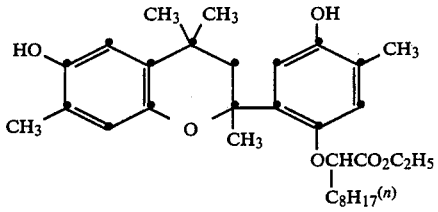
II-7
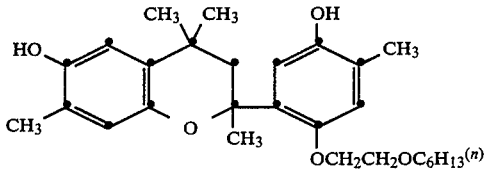
II-8
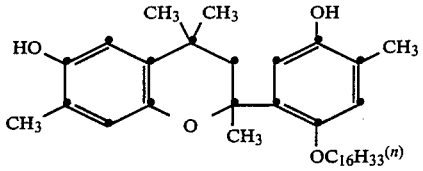
II-9
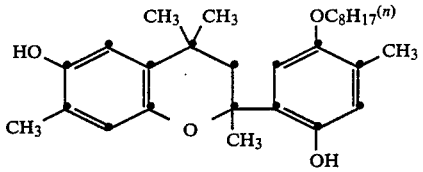
II-10
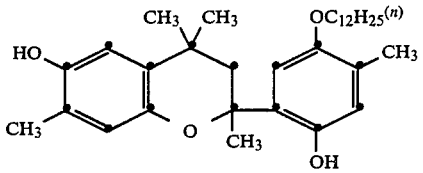
II-11

-continued
II-12
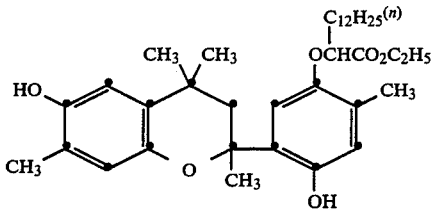
II-13
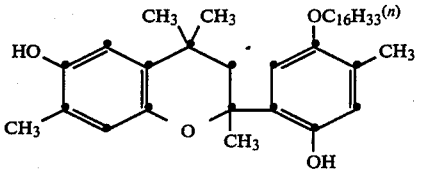
II-14
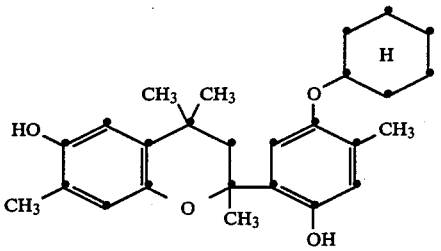
II-15
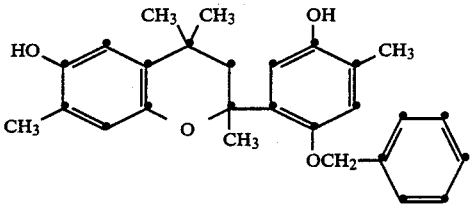
II-16
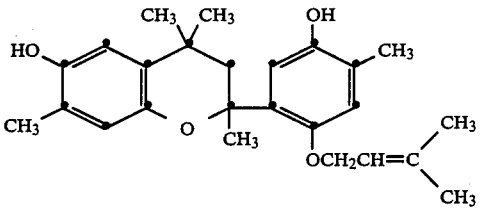
II-17
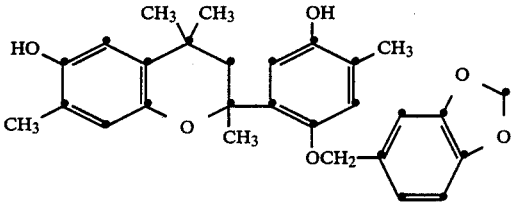
II-18
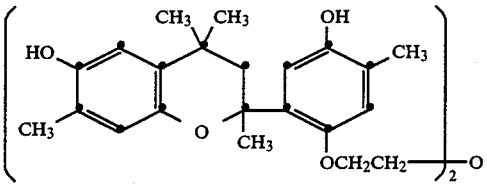

-continued
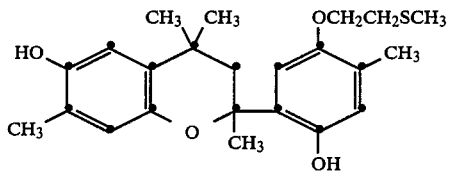
II-19
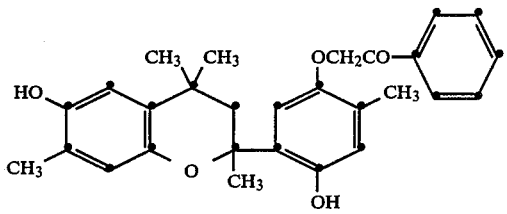
II-20
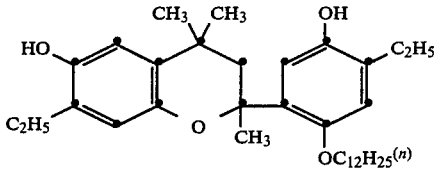
II-21
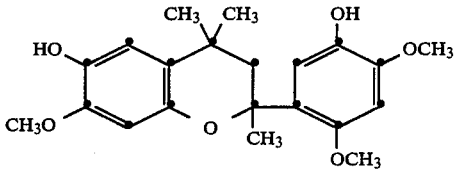
II-22
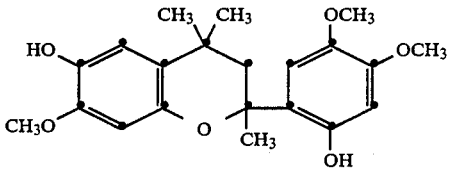
II-23
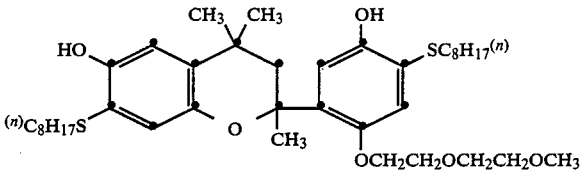
II-24
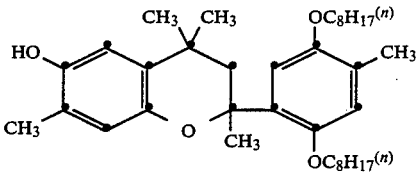
II-25
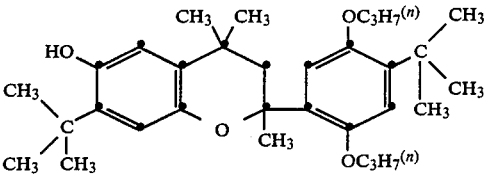
II-26

-continued

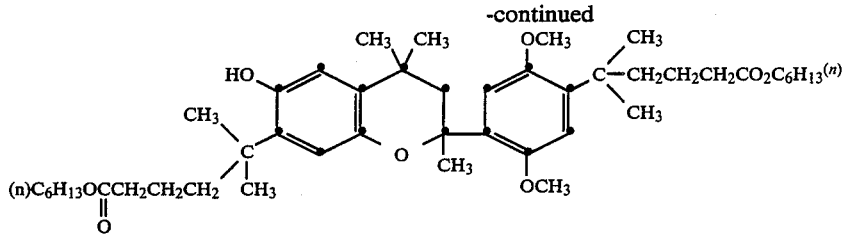

II-27

In formula (III), the substituted or unsubstituted 4-piperidyl group represented by $R_{31}$ is preferably represented by formula (III-p):

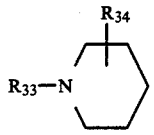

(III-p)

wherein $R_{33}$ represents a substituted or unsubstituted alkyl group (e.g., methyl, propyl, methoxyethyl, hydroxyethyl), a substituted or unsubstituted alkenyl group (e.g., vinyl, allyl), a substituted or unsubstituted alkynyl group (e.g., ethynyl, propargyl), a substituted or unsubstituted aralkyl group (e.g., benzyl, p-methoxybenzyl, phenethyl), or a substituted or unsubstituted acyl group (e.g., acetyl, chloroacetyl, acryloyl, methacryloyl, crotonoyl); and $R_{34}$ represents a hydrogen atom, or one or more substituted or unsubstituted alkyl groups, which may be the same or different, bonded to the piperidine ring (e.g., methyl, ethyl, chloromethyl).

The substituted or unsubstituted alkyl group represented by $R_{32}$ in formula (III) (and bonded to the benzene ring) can be selected from methyl, isopropyl, t-butyl, t-amyl, and chloromethyl groups.

The substituted or unsubstituted alkyl group represented by Y can be a butyl group, a dodecyl group, a β-methoxycarbonylethyl group, a group of formula (III-y):

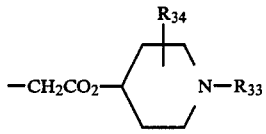

(III-y)

or a group of formula (III-y'):

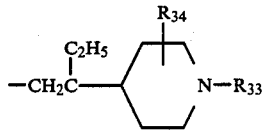

(III-y')

wherein $R_{33}$ and $R_{34}$ are as defined above.

Of the phenolic compounds represented by formula (III), preferred are those represented by formula (III-a):

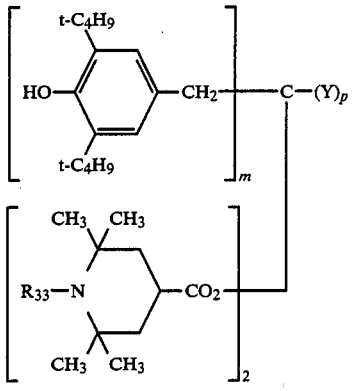

(III-a)

wherein $R_{33}$, Y, m, and p are as defined above.

The compounds of formula (III) are known compounds as described in West German Patent Publication Nos. 2,456,364, 2,647,452, 2,654,058, and 2,656,769, and JP-B-57-20617, and can be synthesized according to the processes disclosed therein. The compounds of formula (III) can be used either individually or in combination.

Specific examples of the compounds of formula (III) are shown below for illustrative purposes only; the present invention is not to be construed as being limited thereto.

III-1

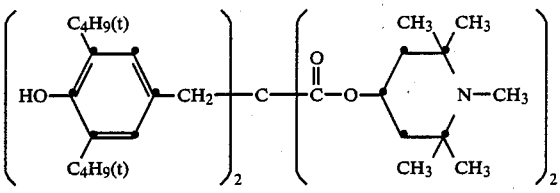

III-2

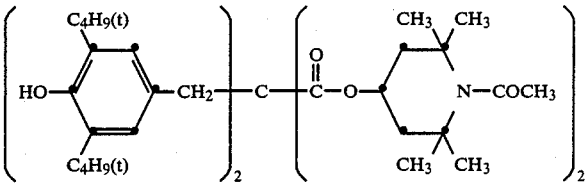

-continued
III-3
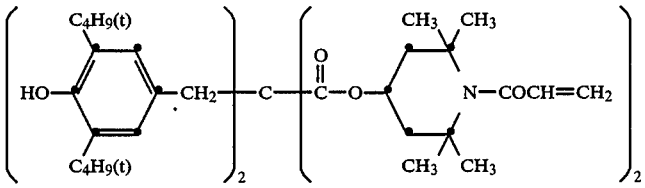
III-4
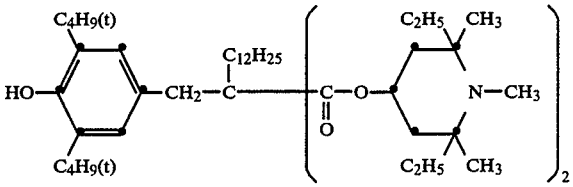
III-5
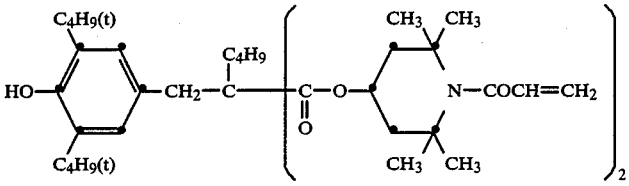
III-6
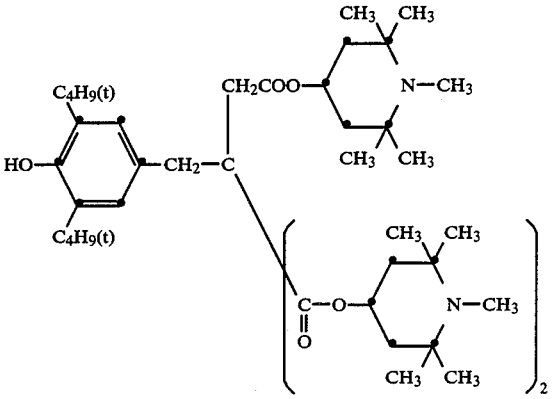
III-7
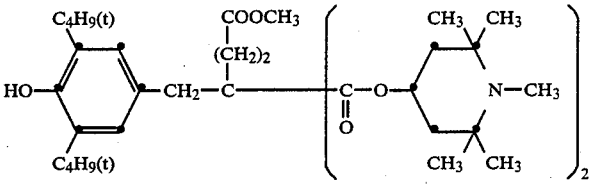
III-8
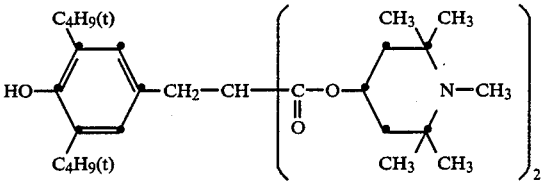
III-9
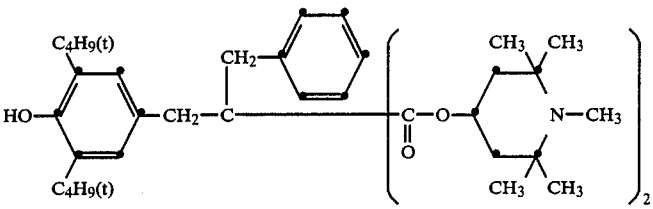

-continued

III-10

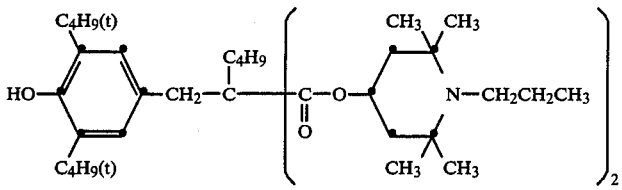

The o-t-butyl phenol compound of the present invention is preferably a hindered phenolic compound. The preferred hindered phenolic compounds are represented by formulae (IV-a) and (IV-b):

(IV-a)

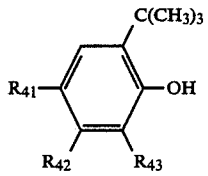

(IV-b)

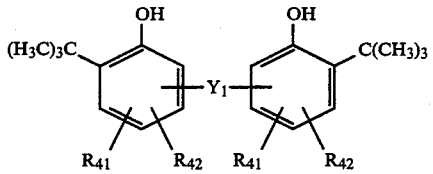

wherein $R_{41}$, $R_{42}$, and $R_{43}$, which may be the same or different, each represents a hydrogen atom, a substituted or unsubstituted alkyl group (preferably having 1 to 12 carbon atoms), a substituted or unsubstituted aryl group (preferably having 6 to 20 carbon atoms), a substituted or unsubstituted alkoxy group (preferably having 1 to 20 carbon atoms, or a halogen atom; and $Y_1$ represents -O-, -S- ,

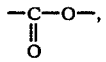

a substituted or unsubstituted alkylene group, or a substituted or unsubstituted arylene group.

Specific examples of the phenolic compounds of formula (IV-a) include 2,6-di-t-butyl-p-cresol, 2,6-di-t-butylphenol, 2,4-dimethyl-t-butylphenol, and 3-t-butyl-4-hydroxyanisole.

Specific examples of the phenolic compounds of formula (IV-b) include 2,2'-methylenebis(4-methyl-6-t-butylphenol), 4,4'-butylidenebis(3-methyl-6-t-butylphenol), 4,4'-methylenebis(2,6-di-t-butylphenol), 1,1,3-tris(2-methyl-4-hydroxy-5-t-butylphenyl)butane, n-octadecyl-3-(3',5'-di-t-butyl-4'-hydroxyphenyl)propionate, pentaerythrityl-tetrakis[3-(3,5-di-t-butyl-4-hydroxyphenyl)]propionate, bis-[3,3-bis(4'-hydroxy-3'-t-butylphenyl)butyric acid]glycol, bis[2-(2-hydroxy-5-methyl-3-t-butylbenzyl)-4-methyl-6-t-butylphenyl]terephthalate, 4,4'-thiobis(3-methyl-6-t-butylphenol), and 4,4'-thio-bis(2-methyl-6-t-butylphenol).

The substituted or unsubstituted o-t-butylphenol compounds can be used either individually or in combination.

If desired, the above-described phenolic compounds according to the present invention can be used in combination with other known discoloration inhibitors. The known discoloration inhibitors include hydroquinones, phenols, chromanols, coumarans, hindered amines, and complexes. Specific examples of these compounds are described, e.g., in JP-A-59-83162, JP-A-58-24141 (corresponding to U.S. Pat. No. 4,430,425), and JP-A-52-152225 (corresponding to U.S. Pat. No. 4,113,495), U.S. Pat. Nos. 3,698,909 and 4,268,593, and British Pat. Nos. 2,069,162(A) and 2,027,731.

The phenolic compound according to the present invention is encapsulized together with the leuco dye and photo-oxidizing agent. The amount of the phenolic compound preferably ranges from 1 to 100 parts, more preferably from 3 to 50 parts, and most preferably from 7 to 25 parts, by weight per 100 parts by weight of the photo-oxidizing agent.

For image formation, the image-forming material of the present invention is exposed to light and then subjected to image fixation, for example, by heating to provide a stable image. In the fixation mechanism, the photo-oxidizing agent and the reducing agent are brought into contact through the capsule wall by, for example, heating, whereby even if the photo-oxidizing agent may be activated by light irradiation after image formation, the oxidizing agent loses its oxidizing capability because it is deactivated by the reducing agent.

The reducing agent typically functions as a free radical scavenger that traps a free radical of the photo-oxidizing agent. Such a free radical scavenger is conventional, and examples thereof specifically include (A) organic reducing agents having a benzene ring carrying (i) at least a hydroxyl group and (ii) an additional hydroxyl group or an amino group at the different position, e.g., ortho-, meta or para-position in relation to the first hydroxyl group, specific examples including hydroquinone, catechol, resorcinol, hydroxyhydroquinone, pyrrologlycinol, and aminophenols (e.g., o-aminophenol, p-aminophenol) as described in U.S. Pat. No. 3,042,515; and (B) cyclic phenylhydrazide compounds as described in JP-B-62-39728, specific examples including 1-phenylpyrazolidin-3-one (i.e., Phenion A as shown in formula (Ph-1) below), 1-phenyl-4-methylpyrazolidin-3-one (i.e., Phenidon B as shown in formula (Ph-2) below), 1-phenyl-4,4-dimethylpyrazolidin-3-one (i.e., Dimezone as shown in formula (Ph-3) below), 3-methyl-1-(p-sulfophenyl)-2-pyrazolin-5-one, and 3-methyl-1-phenyl-2-pyrazolin-5-one.

(Ph-1)

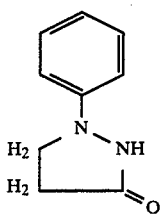

-continued (Ph-2)

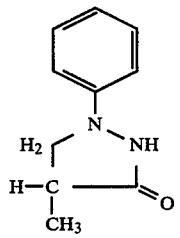

(Ph-3)

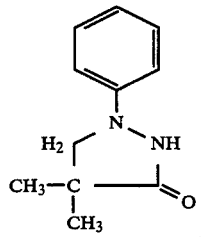

The above-described cyclic phenylhydrazides may have a substituent on their phenyl group, such as an o-, m- or p-methyl group, a p-trifluoromethyl group, an m-or p-chlorine atom, an m- or p-bromine atom, a p-fluorine atom, an o-, m- or p-methoxy group, a p-ethoxy group, a p-benzyloxy group, a p-butoxy group, a p-phenoxy group, a 2,4,6-trimethyl group, and a 3,4-dimethyl group. The cyclic phenylhydrazides may further have a substituent selected from bishydroxymethyl, combination of hydroxymethyl and methyl, hydroxymethyl, dimethyl, dibutyl, ethyl, and benzyl groups at the 4-position of their heterocyclic ring and a substituent selected from dimethyl, methyl and phenyl groups at the 5-position of their heterocyclic ring.

Further examples of the reducing agent of the present invention include guanidine compounds, alkylenediamine compounds, and hydroxylamine compounds. Specific examples of the guanidine compounds include phenylguanidine, 1,3-diphenylguanidine, 1,2,3-triphenylguanidine, 1,2-dicyclohexylguanidine, 1,2,3-tricyclohexylguanidine, 1,3-di-o-tolylguanidine, o-tolyldiphenylguanidine, m-tolyldiphenylguanidine, p-tolyldiphenylguanidine, N,N'-dicyclohexyl-4-morpholinocarboxyamidine, 1,3-ditolyl-3-phenylguanidine, 1,2-dicyclohexylphenylguanidine, 1-o-tolylbiguanidide, and N-benzylideneguanidinoamine.

Specific examples of the alkylenediamine compounds include ethylenediamine, propylenediamine, tetramethylenediamine, hexamethylenediamine, octamethylenediamine, 1,1,2-diaminododecane, and tetrabenzylethylenediamine.

Specific examples of the hydroxylamine compounds include diethanolamine, triethanolamine, and 3-$\beta$-naphthyloxy-1-N,N-dimethylamino-2-propanol.

The above-recited examples of the reducing agent are not limitative, and any other reducing substances having a function to act on an oxidizing agent may be employed. These reducing agents acting as a free radical scavenger can be used either individually or in combinations of two or more thereof.

In the image-forming material of the present invention, the leuco dye, the photo-oxidizing agent, and the phenolic compound are encapsulized. On the other hand, the reducing agent, which is not incorporated into microcapsules, is dispersed in the form of solid particles by means of a sand mill, etc. or dissolved in an oil and then emulsified.

In the case of solid dispersion, the reducing agent is dispersed in a water-soluble high polymer solution having a concentration of from 2 to 30% by weight. A preferred dispersed particle size for the reducing agent is 10 $\mu$m or smaller. The water-soluble high polymer to be used preferably includes those used in the preparation of microcapsules. With respect to materials and processes for the emulsification, Japanese Patent Application No. 62-75409 can be referred to.

The reducing agent is preferably used in an amount of from 1 to 100 mols, more preferably from 1 to 10 mols, per mol of the photo-oxidizing agent.

As mentioned above, fixation of the image can be effected by bringing the photo-oxidizing agent and the reducing agent into contact with each other through the capsule wall. Such contact can be achieved not only by heating but by application of pressure to destroy the capsules. Heating and pressure application may be effected simultaneously to attain synergistic effects.

For the purpose of imparting fixing properties to the image-forming material comprising the leuco dye capable of developing a color on oxidation and the photo-oxidizing agent, it is possible to encapsulize only the reducing agent or, according to the feature of the present invention, to encapsulize the reducing agent in one set of microcapsules in addition to the set of microcapsules containing the leuco dye, photo-oxidizing agent, and phenolic compound.

In the present invention, known sensitizers such as the compounds described in Katsumi Tokumaru and Shin Ohgawara (ed.), *Zokandai,* 64–75, Kodansha (1987) may be used as an additional component besides the photo-oxidizing agent. Examples of the known sensitizers include carbonyl compounds, e.g., aromatic ketones, acetophenones, diketones, and acyloxime esters; sulfur compounds, e.g., aromatic thiols, mono- or di-sulfides, thioureas, and dithiocarbamates; organic peroxides, e.g., benzoyl peroxide; azo compounds, e.g., azobisisobutyronitrile; and halogen compounds, e.g., N-bromosuccinimide.

Further examples of known sensitizers which can be added include sensitizing dyes in the visible region, such as dyes having a chromophoric group of an amidinium ion type, a carboxyl ion type, and a dipolar amide type (e.g., cyanine dyes, phthalein dyes and oxonol dyes) as described in the above literature, pp. 106-123.

If desired, known stabilizers, such as anti-oxidants, may be incorporated into the microcapsules. The stabilizer to be added includes the above-recited free radical scavengers, the compounds described in U.S. Pat. No. 4,066,459, and the 2,4-dihydroxyaldoximes described in JP-A-55-55335 (corresponding to U.S. Pat. No. 4,271,251). As a matter of course, the stabilizer used herein functions similarly to the above-described reducing agents, though differing in purpose of use. It is necessary, therefore, that the amount of the stabilizer to be added should be minimized. More specifically, the stabilizer is preferably used in an amount of from about 0.01 to 25 mol %, more preferably from 0.1 to 10 mol %, based on the photo-oxidizing agent.

The image-forming material of the present invention can be produced by applying a dispersion of (i) microcapsules, which contain the leuco dye, the photo-oxidizing agent and the phenolic compound, and (ii) the reducing agent on a support by coating or impregnation, or by forming a self-supporting layer of the dispersion.

Binders which can be used in the dispersion include emulsions of polyvinyl alcohol, methyl cellulose, carboxymethyl cellulose, hydroxypropyl cellulose, gum arabic, gelatin, polyvinylpyrrolidone, casein, a styrene-butadiene latex, an acrylonitrilebutadiene latex, polyvinyl acetate, polyacrylic esters, an ethylene-vinyl acetate copolymer, etc. The amount of the binder to be used ranges from 0.5 to 5 g/m$^2$ based on a solid conversion.

The dispersion is preferably coated to a dry coverage of from 3 to 30 g/m$^2$, preferably from 5 to 20 g/m$^2$. If the coverage is less than 3 g/m$^2$, a sufficient color density cannot be obtained. Coverages exceeding 30 g/m$^2$ bring no further improvements but increase cost.

Materials suitable as a support include various kinds of paper ranging from tissue paper to paper boards; films of plastics or high-molecular substances, e.g., reproduced cellulose, cellulose acetate, cellulose nitrate, polyethylene terephthalate, vinyl polymers and copolymers, polyethylene, polyvinyl acetate, polymethyl methacrylate, and polyvinyl chloride; woven cloth; plates of glass, wood, and metals; and any other substances generally employed in the field of graphic arts and decoration.

Application of the dispersion to the support can be carried out by well-known coating techniques, such as dip coating, air knife coating, curtain coating, roller coating, doctor coating, wire bar coating, slide coating, gravure coating, spin coating, and extrusion coating by using a hopper as described in U.S. Pat. No. 2,681,294.

For activation of the photo-oxidizing agent and formation of a leuco dye image, any kind of convenient light sources can be employed. The light may be either natural or artificial and may be monochromatic, non- o coherent, or coherent. It is required that the light beams have a sufficient density for proper activation of the image-forming composition.

Examples of commonly employed light sources include a fluorescent lamp, a mercury lamp, and an arc lamp (including a metal arc lamp). Examples of coherent light sources include a nitrogen laser, a xenon laser, an argon ion laser, and ionized neon laser whose emission spectra are within or overlap the UV or visible light absorption band of the photo-oxidizing agent. UV and near visible light irradiation-emission cathode ray tubes which are widely employed in print-out systems for recording on light-sensitive materials are also useful.

Images can be formed by directly recording with beams of actinic light or by exposure to such beams through a negative, a stencil pattern or any other relatively non-transparent patterns. The negative image may be a silver image formed on a cellulose acetate or polyester film or may comprise non-transparent agglomerates of areas having a refractive index different from that of the background. Image formation may also be performed by means of a conventional diazo type printer or a graphic art exposure or electron flash apparatus, or by projection as described in U.S. Pat. No. 3,661,461. The exposure time varies from less than 1 second to several minutes depending on the density and spectral energy distribution of light, the distance between the light source and the image-forming composition, the quality and quantity of the composition, and the desired color image density.

After imagewise exposure to light, the oxidizing agent and the reducing agent are brought into contact to fix the image. The contact can be achieved by various techniques, such as heating and application of mechanical force.

In the case of fixing by heating, the temperature of the capsule wall is elevated up to a temperature above the glass transition point of the wall whereby the photo-oxidizing agent and reducing agent can pass through the thus softened capsule wall and come in contact with each other. The glass transition point of the capsule wall varies depending on the wall constituting materials, and proper heat treating conditions are determined accordingly.

In the case of the application of mechanical force, materials having high glass transition temperatures may be used as capsule wall. The force necessary to destroy the capsule wall varies depending on the wall materials and the size of capsules and can easily be determined by one skilled in the art.

The image-forming materials of the present invention are superior in terms of suitability to production, image-forming properties, and preservability.

The present invention is now illustrated in greater detail by way of the following Examples, but it should be understood that the present invention is not deemed to be limited thereto. In these examples, all the parts and percents are by weight unless otherwise indicated.

EXAMPLE 1

Preparation of Microcapsule Dispersion:

| | |
|---|---|
| Leuco dye: Leuco Crystal Violet | 3.0 parts |
| Photo-oxidizing agent: | |
| 2,2'-Bis(o-chlorophenyl)-4,4',5,5'-tetraphenylbiimidazole | 3.0 parts |
| Tribromomethylphenylsulfone | 0.6 part |
| Phenolic compound (I-2) | 0.4 part |
| Methylene chloride | 22 parts |
| Tricresyl phosphate | 24 parts |
| Takenate D-110N (a trade name, produced by Takeda Chemical Ind., Ltd.; 75 wt % ethyl acetate solution) | 24 parts |

A mixture of the above components was added to an aqueous solution consisting of 63 parts of an 8% aqueous solution of polyvinyl alcohol and 100 parts of distilled water, followed by emulsifying at 20° C. to prepare an emulsion having a mean particle size of 1 μm The resulting emulsion was stirred at 40° C. for 3 hours. After cooling to room temperature, the emulsion was filtered to obtain an aqueous capsule dispersion.

Preparation of Reducing Agent Dispersion:

| | |
|---|---|
| 4% Aqueous solution of polyvinyl alcohol | 150 parts |
| Reducing agent: 1-phenylpyrazolidin-3-one (Phenidon A) | 30 parts |

The above components were mixed and dispersed in a "Dyno mill" (a trade name, manufactured by Willy A. Bachofen A.G.) to obtain a Phenidon A dispersion having a mean particle size of 3 μm.

Preparation of Image-Forming Material:

Nine parts of the capsule dispersion and 6 parts of the Phenidon A dispersion were, mixed, and the resulting composition was coated on a supercalendered fine paper (basis weight: 64 g/m$^2$) to a dry coverage of 10 g/m$^2$ and dried at 50° C. for 1 minute.

The resulting image-forming material was designated as Sample (101).

Samples (102) to (105) were obtained in the same manner as for Sample (101), except for replacing (I-2) with (I-1), (I-6), (I-8) and (I-11), respectively.

For comparison, Sample (A) was obtained in the same manner as for Sample (101), except that (I-2) was not used.

In order to evaluate preservability before use, the background density of each of Samples (101) to (105) and (A) as prepared was determined by the use of a Macbeth reflective densitometer. The samples were then preserved in a dry thermostat at 60° C. for 24 hours and then evaluated for the background density (fog) in the same manner.

In order to evaluate photosensitivity, each sample was exposed to light emitted from "Jet Light" (a ultra-high-pressure mercury lamp manufactured by Oak K.K.) through an original of line image, and the image density of the exposed area was measured by means of a Macbeth reflective densitometer.

The results obtained are shown in Table 1 below.

TABLE 1

| Sample No. | Fresh Background Density | Fog Density after Preservation in Dry Thermostat | Image Density |
|---|---|---|---|
| 101 | 0.069 | 0.072 | 1.20 |
| 102 | 0.070 | 0.084 | 1.18 |
| 103 | 0.069 | 0.101 | 1.21 |
| 104 | 0.071 | 0.098 | 1.20 |
| 105 | 0.070 | 0.097 | 1.22 |
| A | 0.068 | 0.924 | 1.21 |

The results of Table 1 demonstrate that pre-use preservability of image-forming materials can be significantly improved by using a specific phenolic compound without adversely affecting sensitivity.

Then, each of Samples (101 to (105) having been imagewise exposed to light was passed through a heat roller set at 120° C. at a speed of 450 mm/min to increase permeability of the capsule wall to thereby allowing the components inside and outside the capsules to come in contact with one another (fixation). When the resulting samples were irradiated with light of Jet Light in quantity 5 times that used for imagewise exposure, no change of images was observed at all.

EXAMPLE 2

Samples (201) to (205) were obtained in the same manner as for Sample (101) of Example 1, except for replacing (I-2) with (II-2), (II-1), (II-3), (II-5) and (II-11), respectively.

For comparison, Sample (B) was prepared in the same manner as for Sample (A) of Example 1.

Each of samples was evaluated in the same manner as in Example 1. The results obtained are shown in Table 2 below.

TABLE 2

| Sample No. | Fresh Background Density | Fog Density after Preservation in Dry Thermostat | Image Density |
|---|---|---|---|
| 201 | 0.068 | 0.070 | 1.23 |
| 202 | 0.069 | 0.073 | 1.20 |
| 203 | 0.067 | 0.071 | 1.21 |
| 204 | 0.070 | 0.074 | 1.22 |
| 205 | 0.068 | 0.070 | 1.21 |

TABLE 2-continued

| Sample No. | Fresh Background Density | Fog Density after Preservation in Dry Thermostat | Image Density |
|---|---|---|---|
| B | 0.068 | 0.921 | 1.20 |

Then, Samples (201) to (205) were heated for image fixation in the same manner as in Example 1. When the thus-processed samples were irradiated with light of Jet Light in a quantity 5 times that used for imagewise exposure, no change of images was observed at all.

EXAMPLE 3

Samples (301) to (303) were obtained in the same manner as for Sample (101) of Example 1, except for replacing (I-2) with (III-1), (III-2) and (III 3), respectively.

For comparison, Sample (C) was obtained in the same manner as for Sample (A) of Example 1.

Each of Samples (301) to (303) and (C) was evaluated in the same manner as in Example 1, and the results obtained are shown in Table 3 below.

TABLE 3

| Sample No. | Fresh Background Density | Fog Density after Preservation in Dry Thermostat | Image Density |
|---|---|---|---|
| 301 | 0.067 | 0.068 | 1.22 |
| 302 | 0.070 | 0.074 | 1.20 |
| 303 | 0.069 | 0.073 | 1.21 |
| C | 0.068 | 0.921 | 1.23 |

Then, Samples (301) to (303) were heated for image fixation in the same manner as in Example 1. When the thus-processed samples were irradiated with light of Jet Light in a quantity 5 times that used for imagewise exposure, no change of images was observed at all.

EXAMPLE 4

Samples (401) to (403) were obtained in the same manner as for Sample (101) of Example 1, except for replacing (I-2) with 2,6-di-t-butyl-p-cresol, 1,1,3-tris(2-methyl-4-hydroxy-5-t-butylphenyl)butane, and 4,4'-thiobis(3-methyl-6-t-butylphenol), respectively.

Each of the samples was evaluated in the same manner as in Example 1, and the results obtained are shown in Table 4 below.

TABLE 4

| Sample No. | Fresh Background Density | Fog Density after Preservation in Dry Thermostat | Image Density |
|---|---|---|---|
| 401 | 0.068 | 0.081 | 1.24 |
| 402 | 0.069 | 0.079 | 1.21 |
| 403 | 0.067 | 0.078 | 1.22 |

Then, Samples (401) to (403) were heated for image fixation in the same manner as in Example 1. When the thus processed samples were irradiated with light of Jet Light in a quantity 5 times that used for imagewise exposure, no change of images was observed at all.

While the invention has been described in detail and with reference to specific embodiments thereof, it will be apparent to one skilled in the art that various changes and modifications can be made therein without departing from the spirit and scope thereof.

What is claimed is:

1. An image-forming material comprising microcapsules and a reducing agent which is present outside of the microcapsules, wherein the microcapsules contain (a) a leuco dye capable of oxidatively developing a color, (b) a photo-oxidizing agent, and (c) a phenolic compound selected from the group consisting of:

(a) a compound represented by formula (I):

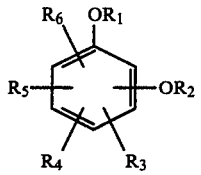

(I)

wherein $R_1$ and $R_2$, which may be the same or different, each represents a hydrogen atom or an alkyl group; $R_3$, $R_4$, $R_5$, and $R_6$, which may be the same or different, each represents a hydrogen atom, an alkyl group, an aryl group, an alkoxy group, an alkylthio group, an acylamino group, a hydroxyl group, or a halogen atom; $OR_1$ or $OR_2$, or both can form a 5- or 6-membered ring with any of $R_3$, $R_4$, $R_5$, and $R_6$ which is at the ortho-position in relation to $OR_1$ or $OR_2$, respectively, and one or more pairs selected from any combination of two of $R_3$, $R_4$, $R_5$ and $R_6$ which are mutually at the ortho-position can form a 5-or 6-membered ring, (b) a compound represented by formula (II):

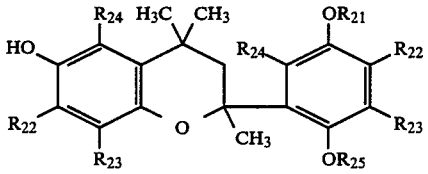

(II)

wherein $R_{21}$ and $R_{25}$ each represents a hydrogen atom, an alkyl group, or a heterocyclic group; and $R_{22}$, $R_{23}$, and $R_{24}$, which may be the same or different, each represents a hydrogen atom, an alkyl group, an aryl group, an alkoxyl group, an aryloxy group, an alkylthio group, an arylthio group, an acylamino group, a diacylamino group, a sulfonamido group, an alkylamino group, an alkoxycarbonyl group, an acyloxy group, or a halogen atom; provided that $R_{21}$ and $R_{25}$ do not simultaneously represent a hydrogen atom, (c) a compound represented by formula (III):

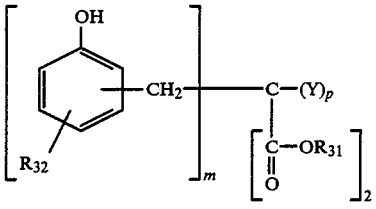

(III)

wherein $R_{31}$ represents a substituted or unsubstituted 4-piperidyl group; $R_{32}$ represents a hydrogen atom, or one or more substituted or unsubstituted alkyl groups, which may be the same or different, and $R_{32}$ is bonded to the benzene ring; Y represents a hydrogen atom or a substituted or unsubstituted alkyl group; m represents 1 or 2; and p represents 0 or 1; provided that m plus p is 2, and (d) a substituted or unsubstituted o-t-butylphenol compound.

2. An image-forming material as in claim 1, wherein $OR_2$ in formula (I) is at the ortho- or para-position with respect to $OR_1$.

3. An image-forming material as in claim 1, wherein the phenolic compound is represented by formula (I), wherein $R_1$, $R_2$, $R_3$, $R_4$, $R_5$, and $R_6$ are as defined in claim 1.

4. An image-forming material as in claim 1, wherein the phenolic compound is represented by Formula (I-a), (I-b), (I-c), (I-d), or (I-e):

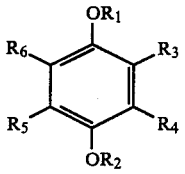

(I-a)

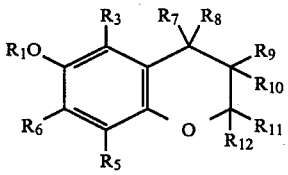

(I-b)

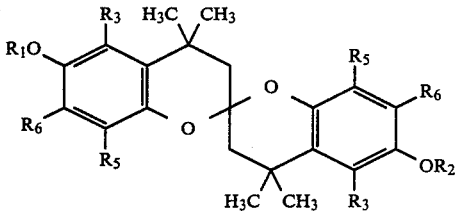

(I-c)

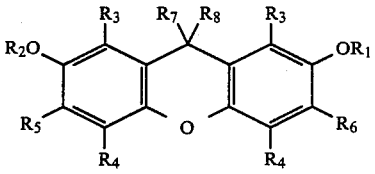

(I-d)

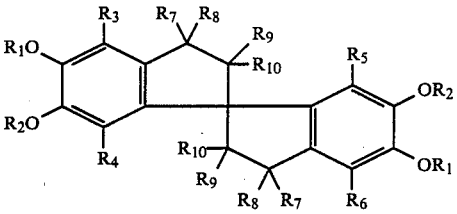

(I-e)

wherein $R_1$, $R_2$, $R_3$, $R_4$, $R_5$, and $R_6$ are as defined in claim 1; and $R_7$, $R_8$, $R_9$, $R_{10}$, $R_{11}$, and $R_{12}$, which may be the same or different, each represents a hydrogen atom, a straight chain, branched chain, or cyclic alkyl group having from 1 to 20 carbon atoms, an aryl group having from 6 to 20 carbon atoms, an alkoxy group having from 1 to 20 carbon atoms, a heterocyclic group, an alkylamino group having from 1 to 20 carbon atoms, or an alkoxycarbonyl group having from 1 to 20 carbon atoms in the alkoxy moiety thereof.

5. An image-forming material as in claim 1, wherein the phenolic compound is represented by formula (II), wherein $R_{21}$ and $R_{25}$ each represents a hydrogen atom, an alkyl group having up to 20 carbon atoms, or a heterocyclic group; provided that they do not simultaneously represent a hydrogen atom; and $R_{22}$, $R_{23}$, and $R_{24}$ each represents a hydrogen atom, an alkyl group having up to 20 carbon atoms, an aryl group having up to 20 carbon atoms, an alkoxy group having up to 20 carbon atoms, an aryloxy group having up to 20 carbon atoms, an alkylthio group having up to 20 carbon atoms, an arylthio group having up to 20 carbon atoms, an acylamino group having up to 20 carbon atoms, a diacylamino group having up to 30 carbon atoms, a sulfonamido group having up to 20 carbon atoms, an alkylamino group having up to 30 carbon atoms, an acyl group having up to 20 carbon atoms, an alkoxycarbonyl group having up to 20 carbon atoms, an acyloxy group having up to 20 carbon atoms, or a halogen atom.

6. An image-forming material as in claim 5, wherein one of $R_{21}$ and $R_{25}$ is a hydrogen atom, and the other is an alkyl group; and $R_{23}$ and $R_{24}$ both represent a hydrogen atom.

7. An image-forming material as in claim 5, wherein the phenolic compound is represented by formula (II-a):

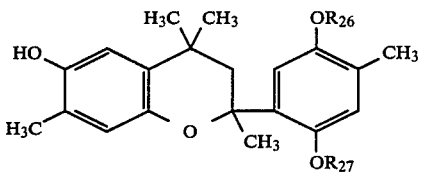

(II-a)

wherein $R_{26}$ and $R_{27}$ each represents a hydrogen atom or an alkyl group, provided that $R_{26}$ and $R_{27}$ do not simultaneously represent a hydrogen atom.

8. An image-forming material as in claim 1, wherein the phenolic compound is represented by formula (III) wherein $R_{31}$, Y, m, and p are as defined in claim 1.

9. An image-forming material as in claim 8, wherein the substituted or unsubstituted 4-piperidyl group represented by $R_{31}$ in formula (III) is represented by formula (III-p):

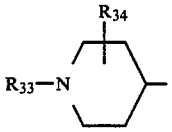

(III-p)

wherein $R_{33}$ represents a substituted or unsubstituted alkyl group, a substituted or unsubstituted alkenyl group, a substituted or unsubstituted alkynyl group, a substituted or unsubstituted aralkyl group, or a substituted or unsubstituted acyl group; and $R_{34}$ represents a hydrogen atom, or one or more substituted or unsubstituted alkyl groups, which may be the same or different, bonded to the piperidine ring.

10. An image-forming material as in claim 8, wherein the phenolic compound is represented by formula (III-a):

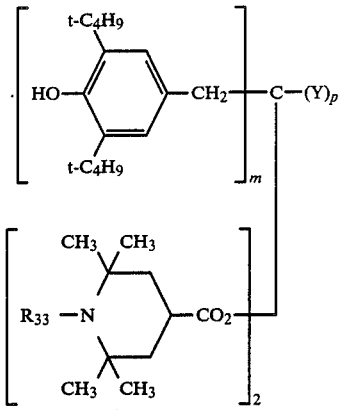

(III-a)

wherein $R_{33}$, Y, m, and p are as defined in claim 9.

11. An image-forming material as in claim 1, wherein the phenolic compound is a substituted or unsubstituted o-t-butyl phenol compound.

12. An image-forming material as in claim 11, wherein the phenolic compound is a hindered compound.

13. An image-forming material as in claim 12, wherein the phenol compound is represented by formula (IV-a) or formula (IV-b):

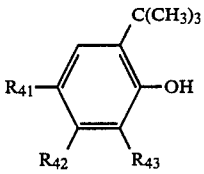

(IV-a)

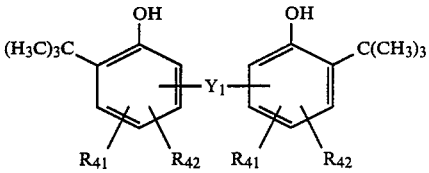

(IV-b)

wherein $R_{41}$, $R_{42}$, and $R_{43}$, which may be the same or different, each represents a hydrogen atom, a substituted or unsubstituted alkyl group, a substituted or unsubstituted aryl group, a substituted or unsubstituted alkoxy group, or a halogen atom; and $Y_1$ represents $$-O-,\ -S-,\ -\underset{\underset{O}{\|}}{C}-O-,$$

a substituted or unsubstituted alkylene group, or a substituted or unsubstituted arylene group.

14. An image-forming material as in claim 1, wherein the phenolic compound is present in an amount of from 1 to 100 parts by weight per 100 parts by weight of the photo-oxidizing agent.

15. An image-forming material as in claim 1, wherein the phenolic compound is present in an amount of from 3 to 50 parts by weight per 100 parts by weight of the photo-oxidizing agent.

16. An image-forming material as in claim 1, wherein the phenolic compound is present in an amount of from 7 to 25 parts by weight per 100 parts by weight of the photo-oxidizing agent.

17. An image-forming material as in claim 1, wherein the photo-oxidizing agent is a lophine dimer compound, an organic halogen compound, or a combination thereof.

18. An image-forming material as in claim 1, wherein the molar ratio of the leuco dye to the photo-oxidizing agent is from about 10:1 to about 1:10.

19. An image-forming material as in claim 18, wherein the molar ratio of the leuco dye to the photo-oxidizng agent is from 2:1 to 1:2.

20. A method for recording an image comprising imagewise exposing to light an image-forming material which comprises microcapsules and a reducing agent which is present outside of the microcapsules, wherein the microcapsules contain (a) a leuco dye capable of oxidatively developing a color, (b) a photo-oxidizing agent, and (c) a phenolic compound selected from the group consisting of:

(a) a compound represented by formula (I):

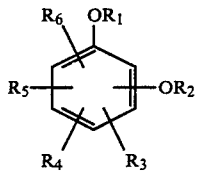

(I)

wherein $R_1$ and $R_2$, which may be the same or different, each represents a hydrogen atom or an alkyl group; $R_3$, $R_4$, $R_5$, and $R_6$, which may be the same or different, each represents a hydrogen atom, an alkyl group, an aryl group, an alkoxy group, an alkylthio group, an acylamino group, a hydroxyl group, or a halogen atom; either $OR_1$ or $OR_2$, or both can form a 5- or 6-membered ring with any of $R_3$, $R_4$, $R_5$, and $R_6$, which is at the ortho-position in relation to with respect to $OR_1$ or $OR_2$, respectively, and one or more pairs selected from $R_3$, $R_4$, $R_5$ and $R_6$ which are mutually at the ortho-position can form a 5-or 6-membered ring, (b) a compound represented by formula (II):

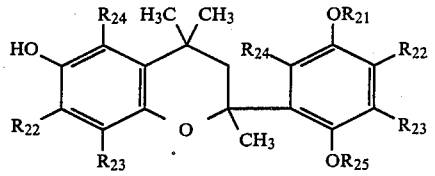

(II)

wherein $R_{21}$ and $R_{25}$ each represents a hydrogen atom, an alkyl group, or a heterocyclic group; and $R_{22}$, $R_{23}$, and $R_{24}$, which may be the same or different, each represents a hydrogen atom, an alkyl group, an aryl group, an alkoxyl group, an aryloxy group, an alkylthio group, an arylthio group, an acylamino group, a diacylamino group, a sulfonamido group, an alkylamino group, an alkoxycarbonyl group, an acyloxy group, or a halogen atom; provided that $R_{21}$ and $R_{25}$ do not simultaneously represent a hydrogen atom, (c) a compound represented by formula (III):

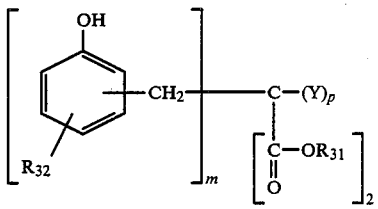

(III)

wherein $R_{31}$ represents a substituted or unsubstituted 4-piperidyl group; $R_{32}$ represents a hydrogen atom, or one or more substituted or unsubstituted alkyl groups, which may be the same or different, and $R_{32}$ is bonded to the benzene ring; Y represents a hydrogen atom or a substituted or unsubstituted alkyl group; m represents 1 or 2; and p represents 0 or 1; provided that m plus p is 2, and (d) a substituted or unsubstituted o-t-butylphenol compound to form an image, and then bringing said photo-oxidizing agent and said reducing agent into contact with one another to fix the formed image.

* * * * *